United States Patent [19]

Eckenrode

[11] 4,369,810

[45] Jan. 25, 1983

[54] RADIATOR VENT VALVE

[76] Inventor: Lewis A. Eckenrode, 284 Philadelphia Ave., Chambersburg, Pa. 17201

[21] Appl. No.: 196,126

[22] Filed: Oct. 10, 1980

[51] Int. Cl.[3] ..... F16K 37/00

[52] U.S. Cl. ..... 137/556; 251/216; 251/225; 251/339

[58] Field of Search ..... 251/339, 215, 216, 225, 251/148, 152; 137/553, 556, 587; 237/16, 70, 71; 220/303; 138/44, 45, 46

[56] References Cited

U.S. PATENT DOCUMENTS

| | | | |
|---|---|---|---|
| 497,298 | 5/1893 | Bromeld | 137/587 X |
| 694,746 | 3/1902 | Hanna | 251/215 X |
| 1,078,584 | 11/1913 | Jones | 138/46 |
| 1,275,750 | 8/1918 | Riesberg | 236/65 |
| 1,410,723 | 3/1922 | Rogers | 251/215 X |
| 1,778,612 | 10/1930 | Tweed | 235/201 |
| 2,266,321 | 12/1941 | Holder | 251/339 X |
| 2,287,075 | 6/1942 | Yonkers | 236/64 |
| 2,340,220 | 1/1944 | Hedfield | 236/64 |
| 2,771,902 | 11/1956 | Winchester | 251/148 X |
| 3,166,666 | 1/1965 | Williams, Jr. | 237/16 |

*Primary Examiner*—A. Michael Chambers

*Attorney, Agent, or Firm*—Schuyler, Banner, Birch, McKie & Beckett

[57] ABSTRACT

A vent valve (10) is disclosed. The valve (10) is comprised of a conduit (12), a cap (14), a nut (16) a bolt (18) and a coupling (20). The coupling (20) connects with a conduit (12) to a radiator (12). A pair of slots (44) in the nut (16) form a vent passage for steam and air to escape the valve (10).

5 Claims, 5 Drawing Figures

RADIATOR VENT VALVE

TECHNICAL FIELD

The present invention relates to a vent valve for use with steam or hot water radiators. The vent valve is particularly adapted for use with steam and hot water radiators which are heated by an intermittently fired furnace, such as a gas or oil furnace.

BACKGROUND OF THE INVENTION

It is generally recognized that steam and hot water radiators cannot efficiently transfer heat through the radiator walls if air is present in the heating medium. Numerous types of vent valves have been used with prior art steam and hot water radiators. Some of these valves rely on floating or thermally expansible elements to control venting of air. The pior art vent valves have been generally complex in construction and, hence, relatively expensive. Also, it is applicant's belief that existing vent valves have been designed specifically for use with continuously fired furnaces such as coal burning furnaces, wherein pressure within the radiators reached two or more p.s.i.g. Applicant has found that some prior art vent valves are not suitable for use with intermittently fired steam and hot water heating systems wherein lower pressures in the order of one p.s.i.g. occur; for example air locks may develop and the radiator may fail to develop any appreciable heat because the air locks inhibits the flow of heating medium from the furnace to the radiator.

A number of prior art valves are disclosed the U.S. Pat. Nos. 1,275,750; 1,778,612; 2,287,075 and 2,340,220.

SUMMARY OF THE INVENTION

The present invention is directed to a vent valve for use with heating radiators. The vent valve includes a conduit with a lower inlet adapted to be placed in fluid communication with a radiator. The conduit has a hollow interior with an upper outlet port, a first section and a second section upstream of said first section. The first section has a first interior cross-section and the second section has a second interior cross-section, which is less than the first interior cross-section. A blocking rod is movably connected to the conduit and extends into the hollow interior of the conduit. The rod has a portion movable into and out of the second section to form a variable constricted condensation area between the exterior surface of the rod and the interior surface of the second section. A means is provided for exteriorly adjusting and setting the position of the rod within the hollow interior of the conduit to adjust and set the amount of the constricted condensation area.

In a preferred embodiment, the conduit has a generally horizontally extending portion, a generally vertical portion extending upwardly therefrom and a hollow interior extending through both portions of the conduit. The vertical portion of the conduit has a threaded exterior and an upper edge. A cap is provided which has a threaded surface to mate with the threaded exterior of the vertical portion. The cap is threaded down on the vertical portion. The cap also has an upper interior surface. A nut is supported on the upper edge of the vertical portion within and beneath the cap. The nut is secured thereto by contact with the upper interior surface of the cap. A bolt, which serves as the blocking rod, is threaded into the nut and extends into the hollow interior of the vertical portion of the conduit. At least one slot is formed in the nut to provide a vent passage from the hollow interior of the conduit.

The conduit is preferably comprised of a compression elbow. The hollow interior of the vertical portion has the wide cross-section of a first diameter and the narrow section of a second diameter less than the first diameter. The narrow section is disposed below the wide section, i.e. upstream of the wide section, and the bolt has a length sufficient to reach into the narrow section when the bolt is screwed downwardly through the nut. By screwing the bolt into the narrow section, the venting through the valve can be controlled. A pair of slots through the nut are formed from the exterior surface of the nut and extend inwardly. In this manner, the slots can disperse the air exiting the valve.

In an experiment with a vent valve of the present invention, applicant was able to obtain heat through a radiator fired by an oil furnace, whereas the utilization of a conventional vent valve was incapable of doing so. The elbow includes an interior 90° bend between the horizontal and vertical portions of the conduit. The 90° bend throttles the steam and air passing through the valve. When the bolt is screwed down into the narrow section of the hollow interior a narrow annular space is formed through which the steam and air can be further throttled. By moving the bolt in and out of the narrow section, the amount of throttling can be controlled. The vent valve of the present invention provides adequate venting and control of steam and water radiators used in conjunction with intermittently heated furnaces, such as gas or oil fired furnaces. The vent valve of the present invention utilizes stock parts and, hence, is of simple, inexpensive and reliable construction.

Various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there are illustrated and described several embodiments of the invention.

DETAILED DESCRIPTION OF THE INVENTION

Figure 1:
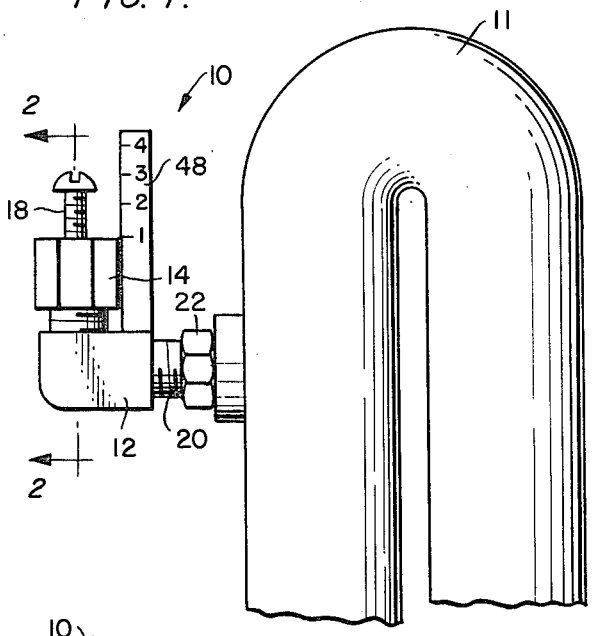
FIG. 1 is a side elevational view of a vent valve in accordance with the present invention attached to a portion of a radiator.

Referring to the drawings in detail, wherein like numerals indicate like elements, there is shown in FIG. 1 a vent valve in accordance with the present invention designated generally as 10. In FIG. 1, the vent valve 10 is shown attached to a portion of a radiator 11. The radiator 11 is a steam or water radiator used in a home or commercial building heating system. The heating system is preferably fired by a gas or oil burner, which fires intermittently.

The vent valve 10 is comprised of a conduit 12, a cap 14, a nut 16, a bolt 18 and a coupling 20. The coupling 20 is a threaded coupling having tapered exterior threads. The coupling 20 is threaded into a tapered threaded hole formed in a vertical side of the radiator 11 and is locked in position by a nut 22. The conduit 12 includes a first portion 24 and a second portion 26 extending upwardly from the first portion 24 at a 90° angle. The portion 24 has a threaded interior section 28 which threads onto the coupling 20. When the conduit 12 is threaded onto the coupling 20, the first portion 24 is disposed generally horizontally and the second portion 26 extends upwardly therefrom in a generally vertical direction.

The second portion 26 of the conduit 12 has a threaded exterior surface 30 and an upper annular edge 32. The nut 16 is supported upon the upper annular edge 32. The cap 14 has a threaded interior surface 33 mating with the threaded exterior surface 30. The cap 14 is threaded down onto the conduit 12 until an upper interior surface 34 contacts the nut 16 to hold the nut 16 in place on the edge 32.

The first and second portions 24, 26 of the conduit 12 have a hollow interior extending through them. The second portion 26 has a first wide section 36 of a first diameter and a second narrow section 38 of a second diameter. The second diameter is less than the first diameter. A tapered section 40 connects the wide section 36 to the narrow section 38 and has a diameter which tapers inwardly from the first diameter to the second diameter. The wide section 36 is disposed above of the narrow section 38, and the narrow section 38 is disposed above the hollow interior of the first portion 24, which has a diameter greater than the diameter of narrow section 38.

Figure 2:
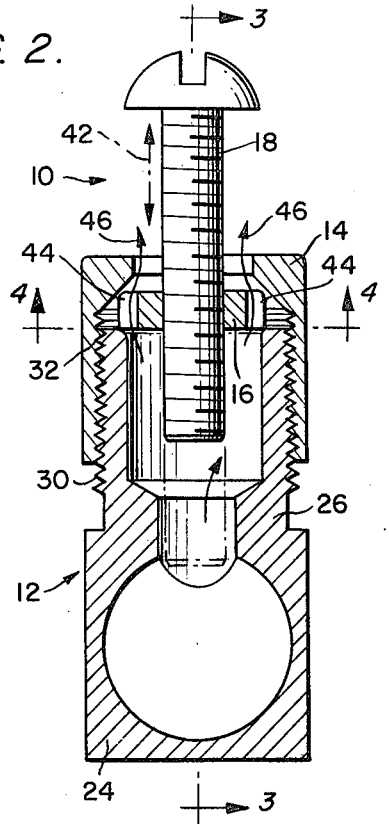
FIG. 2 is a sectional view taken generally along line 2—2 of FIG. 1 on an enlarged scale.
Figure 3:
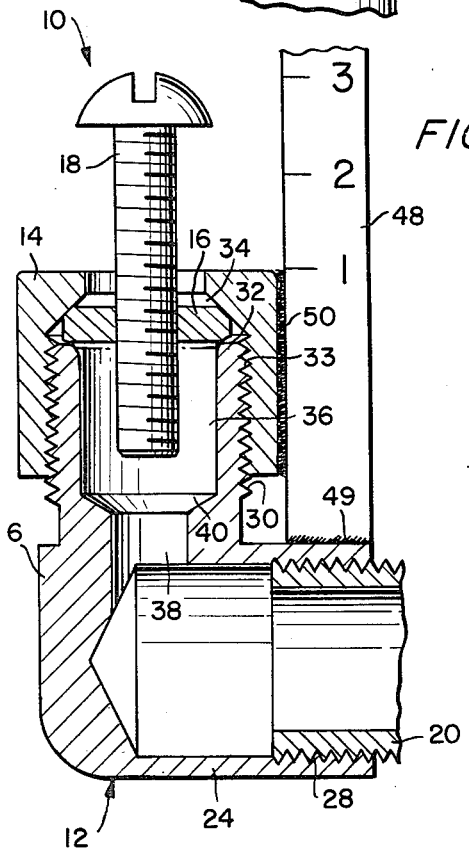
FIG. 3 is a sectional view taken generally along line 3—3 of FIG. 2.
Figure 4:
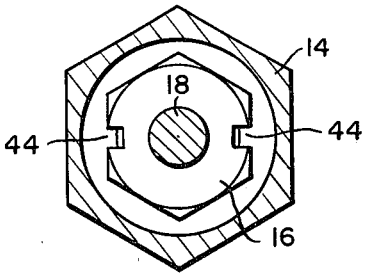
FIG. 4 is a sectional view taken generally along line 4—4 of FIG. 2.
Figure 5:
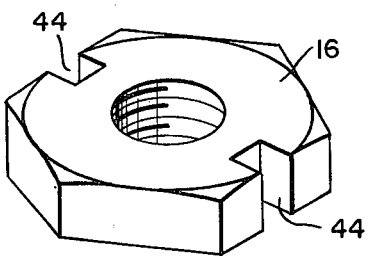
FIG. 5 is a perspective view of a slotted nut used in a vent valve of the present invention.

The bolt 18 is threaded into the nut 16 and is movable upwardly and downwardly as shown by arrows 42. The position of the bolt 18 in the hollow interior of the conduit 12 can thereby be adjusted and set. A pair of slots 44 are formed in the nut 16. The slots 44 extend from the outer perimeter of the nut 16 inwardly, approximately three quarters of the way to the threaded inner surface of the nut 16. As shown by arrows 46, air or steam is vented from the valve 10 through the slots 44. The bolt 18 can be screwed completely down to seal the slots 44 in order to completely stop the venting. To control the venting intermediately, the bolt 18 can be threaded down so that its lower end extends to the narrow section 38, as shown in phantom line in FIG. 2. The bolt 18 thus functions as a blocking rod. As the bottom of bolt 18 enters the narrow section 38, a confined annular throttling area is formed between the outer surface of bolt 18 and the inner surface of narrow section 38. As the bolt 18 extends more and more into the narrow section 38 additional surface area on the bolt 18 and the narrow section 38 within the confined annular area is presented for condensation. An indicator strip or gauge 48 is attached to the conduit 12. The gauge 48 has indicia on both of its faces (only one face is shown), and is used to determine the amount which the bolt 18 is screwed into the conduit 12. Gauge 48 may be soldered or brazed at 49 to conduit 12, and at 50 to cap 14 after the valve is assembled, to lock the cap in position on the conduit (see FIG. 3).

In one suitable embodiment of the invention, the various parts of the valve 10 are fabricated of brass as follows. Overall dimensions of the valve are $1\frac{5}{8}$ inch high, $1\frac{1}{2}$ inch wide and $\frac{1}{2}$ inch thick. The conduit 12 is formed of $\frac{1}{4}$th inch by $\frac{1}{8}$th inch compression elbow having a brass body with a threaded nipple cast on one end. The wide section 36 has a 5/16th of an inch diameter and the narrow section 38 has a 3/16th of a inch diameter. The nut 16 is a $\frac{1}{8}$th inch hex nut and the bolt 18 is a $\frac{1}{8}$th by $\frac{3}{4}$ inch bolt. The slots 44 in the nut 16 are 1/32nd of an inch wide. Coupling 20 is a $\frac{1}{8}$ inch threaded hex nipple, $\frac{7}{8}$ inch long. Gauge 48 may be made from 3/16 inch bar stock, $1\frac{1}{8}$ inch long.

The valve 10 operates in the following manner. Steam and air enter the valve 10 from the radiator 11 through the coupling 20. Steam and air pass through the narrow 3/16th inch diameter section 38. If the $\frac{1}{8}$th inch bolt 18 is screwed down into the narrow section 38, only a 1/16th inch clearance is left in this area for steam and air passage. The steam condensed on the surface of the narrow section 38 and bolt 18. The air and remaining steam enter the wide sectiom 36, which has approximately a 5/16th inch diameter, where further condensation of steam occurs. The steam and air then exit through the slots 44 in the $\frac{1}{8}$th inch nut 16. Steam condenses in the recess between the end of cap 14 and nut 16. Exiting air is diverted sideways because the end of the cap 14 extends beyond the slots 44 of the nut 16. Condensate returns to the radiator 11 by gravity. The valve thus acts as an air/stream separator, venting primarily air to the atmosphere to permit the steam to more fully transfer its heat through the radiator walls.

The valve 10 is regulated in the following manner with a steam radiator. With the bolt 16 turned all the way down, the valve 10 is in a closed or off position. As the bolt 16 is turned up, it allows more air (and some steam) to escape the valve 10. This speeds the flow of steam from the furnace to the radiator, causing the radiator to become hotter. By turning the bolt 16 down, less air and steam can escape the valve 10. This slows the flow of steam from the furnace to the radiator, causing the radiator to become colder. With hot water radiators, the bolt 16 should be turned all the way down to its closed position. To vent a hot water radiator, the bolt 16 is turned up for a few minutes and then shut tight. To drain the valve 10 in a hot water radiator, the bolt 16 is removed and the valve 10 is inverted. A container is placed below the valve 10 to collect the water. Thereafter the valve 10 is turned to its upright position, and the bolt 10 is replaced and turned down tight. In a particularly hard to heat steam radiator, the bolt 16 can be removed entirely. However, this is very seldom necessary. The vent valve 10 thus provides simple and reliable venting of steam and water radiators without the requirement of floating or spring biased elements as used in prior art vent valves.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

I claim:

1. A vent valve for use with a radiator comprising:

a conduit adapted to be placed in fluid communication with a radiator, said conduit having a first portion, a second portion extending transversely therefrom and a hollow interior extending through said portions of said conduit;

said hollow interior of said second portion of said conduit having a wide section of a first diameter, a narrow section of a second diameter less than said first diameter, and a tapered section disposed between said wide and narrow sections and having a diameter tapering between said first and second diameters, said narrow section being disposed below said wide section;

said second portion having a threaded exterior and an upper edge;

a cap having a threaded interior surface mating with the threaded exterior of said second portion and an upper interior surface with a hole formed therethrough, said cap being threaded down into said second portion;

a nut supported on said upper edge within and beneath said cap and secured thereto by contact with said upper interior surface of said cap;

a bolt having a head facing outward and a body extending inward through said hole, threaded into said nut and extending into the hollow interior of said second portion of said conduit said bolt having a length sufficient for its body to reach into said narrow section when said bolt is screwed downwardly through said nut; and at least one opening formed through said nut to provide a vent passage from said hollow interior of said conduit.

2. A vent valve in accordance with claim 1 wherein said at least one opening includes a pair of said slots formed in said nut, each slot extending from the outer circumference of said nut inwardly.

3. A vent valve in accordance with claim 2 wherein said conduit is comprised of a compression elbow with the wide section of the hollow interior having a diameter of 5/16th of an inch and the narrow section of said hollow interior having a diameter of 3/16th of an inch, said nut being an $\frac{1}{8}$th inch nut and said bolt being a $\frac{1}{8}$th inch bolt, and each of said slots having a width of 1/32nd of an inch.

4. A vent valve in accordance with claim 1 including connector means for connecting said valve in fluid communication to the radiator such that said first portion of said conduit extends generally horizontally and said second portion of said conduit extends generally vertically.

5. A vent valve in accordance with claim 1 including an indicator gauge attached to and extending from said conduit adjacent to said bolt whereby the position of said bolt can be gauged.

* * * * *